United States Patent [19]

Maucher et al.

[11] Patent Number: 4,487,173

[45] **Date of Patent: * Dec. 11, 1984**

[54] APPARATUS FOR STARTING AN INTERNAL COMBUSTION ENGINE

[75] Inventors: Paul Maucher, Sasbach; Hugo-Werner Geschka, Düsseldorf, both of Fed. Rep. of Germany

[73] Assignee: Luk Lamellen und Kupplungsbau GmbH, Bühl, Fed. Rep. of Germany

[ * ] Notice: The portion of the term of this patent subsequent to Sep. 7, 1999 has been disclaimed.

[21] Appl. No.: 414,433

[22] Filed: Sep. 2, 1982

Related U.S. Application Data

[63] Continuation-in-part of Ser. No. 101,547, Dec. 7, 1979, Pat. No. 4,347,813.

[30] Foreign Application Priority Data

Dec. 18, 1978 [DE] Fed. Rep. of Germany ..... 2853130

[51] Int. Cl.[3] ..... F02N 5/04

[52] U.S. Cl. ..... 123/179 J; 123/179 F; 123/179 M; 74/572

[58] Field of Search ..... 123/179 J, 179 F, 179 M, 123/179 R; 74/572

[56] References Cited

U.S. PATENT DOCUMENTS

| | | | |
|---|---|---|---|
| 1,257,428 | 2/1918 | Vincent | 123/179 M |
| 1,744,868 | 1/1930 | Cox | 123/179 M |
| 2,338,403 | 1/1944 | Callsen | 123/179 J |
| 2,531,788 | 11/1950 | Ricardo | 123/179 J |
| 2,715,396 | 8/1955 | Silberstein | 123/179 J |
| 2,877,755 | 3/1959 | Danilewicz | 123/179 J |
| 3,182,650 | 5/1965 | Heckt | 123/179 F |
| 3,465,353 | 9/1969 | Buxton et al. | 123/179 M |
| 3,811,281 | 5/1974 | Wise et al. | 123/179 F |
| 3,882,950 | 5/1975 | Strohlein | 123/179 J |
| 4,347,813 | 9/1982 | Maucher et al. | 123/179 J |

FOREIGN PATENT DOCUMENTS

| | | | |
|---|---|---|---|
| 608318 | 9/1948 | United Kingdom | 123/179 J |

*Primary Examiner*—Andrew M. Dolinar
*Attorney, Agent, or Firm*—Peter K. Kontler

[57] ABSTRACT

Apparatus for starting an internal combustion engine, wherein the engine is started in automatic response to engagement of a clutch between the flywheel and the crankshaft of the engine, has an electric motor which not only can rotate a starter wheel for the flywheel but can also automatically start a pump serving to change the pressure of fluid in the fluid-containing clutch actuating device of the apparatus when such pressure is excessive or too low so that the device cannot engage the clutch. The speed of the flywheel and the quantity of energy stored by the flywheel can be changed in dependency on several parameters including the temperature of oil in the engine.

40 Claims, 3 Drawing Figures

APPARATUS FOR STARTING AN INTERNAL COMBUSTION ENGINE

CROSS-REFERENCE TO RELATED CASE

This is a continuation-in-part of our commonly owned copending application Ser. No.101,547 filed Dec. 7, 1979 for "Apparatus for starting an internal combustion engine", now U.S. Pat. No. 4,347,813 granted Sept. 7, 1982.

BACKGROUND OF THE INVENTION

The present invention relates to improvements in apparatus for starting an engine, especially an internal combustion engine. More particularly, the invention relates to improvements in engine starting apparatus of the type wherein at least one of the components is actuated by a fluid medium.

It is already known to equip internal combustion engines for use in automotive vehicles, or for use in or with stationary machines, with fluid-operated suction pumps which serve to supply fuel to the engine. In many instances, one resorts to a pressure accumulator with which the pump is operatively connected so that it can supply the fuel at a required rate, e.g., during starting of the engine. The starting operation presents problems, or the starting of the vehicle or another machine is plain impossible, if the pressure accumulator (e.g., a plenum chamber or an evacuated vessel) is damaged because, under such circumstances, the (subatmospheric or superatmospheric) pressure which is required to ensure satisfactory operation of the pump is not available.

OBJECTS AND SUMMARY OF THE INVENTION

An object of the invention is to provide an apparatus which can reliably start an engine by invariably establishing that fluid pressure which is necessary to trigger the onset or to sustain the progress of the starting operation.

Another object of the invention is to provide an apparatus which can be used in, or in combination with, engines to turn on an engine through the medium of a flywheel.

A further object of the invention is to provide the apparatus with novel and improved means for automatically establishing the necessary fluid pressure preparatory to actual starting of the engine if the (subatmospheric or superatmospheric) pressure is unsatisfactory at the time the engine is about to be started.

An additional object of the invention is to provide an apparatus which is designed to take into consideration one, two, three or more different parameters that influence the behavior of an engine during and subsequent to starting.

Another object of the invention is to provide the apparatus with novel and improved means which ensures reliable starting of an internal combustion engine in cold or hot climates and which can be readily installed in existing vehicles, motor-pump aggregates or other systems employing stationary or mobile internal combustion engines.

A further object of the invention is to provide a novel and improved method of starting an internal combustion engine for automotive vehicles, heat pumps or other types of machines.

Another object of the invention is to provide the apparatus with novel and improved means for ensuring the establishment of satisfactory superatmospheric or subatmospheric pressures immediately or shortly after the operation which is intended to lead to the starting of an engine is initiated by a driver, by an attendant or by another authorized person.

The invention is embodied in an apparatus for starting an engine by a flywheel, particularly for starting the internal combustion engine of an automotive vehicle. The apparatus comprises automatically engageable and disengageable clutch means which is interposed between the engine and the flywheel, a starter wheel which is movable (preferably automatically) into and from engagement with the flywheel and/or vice versa in disengaged condition of the clutch means to thereby accelerate the flywheel to a predetermined speed at which the flywheel stores a sufficient amount of energy to start the engine in response to engagement of the clutch means, fluid-operated actuating means which includes pump means and serves to preferably automatically engage the clutch means (e.g., through the medium of a suitable linkage) and to thus set the engine in operation when the flywheel is accelerated to the predetermined speed, and single electric motor means which serves to drive the starter wheel as well as to preferably automatically start the pump means on completion of the circuit of the motor means. The term "pump means" is intended to denote any device or devices which can be driven by the motor means to thereby change the pressure of fluid in the fluid-containing system of the clutch actuating means. In other words, when the pump means is in operation, the pressure of fluid in at least a portion of the fluid-containing system of the clutch actuating means changes, either by rising further above or by dropping further below atmospheric pressure. The apparatus can include means for connecting the motor means with the pump means subsequent to starting of the motor means and prior to establishment of a torque-transmitting connection between the motor means and the starter wheel so that (if necessary) the pump means changes the pressure of fluid in the system to a preselected value at which the connecting means then couples the motor means with the starter wheel.

The apparatus can be further equipped with means (e.g., an electric switch) for selectively connecting the motor means with the pump means and with the starter wheel on demand. Also, the apparatus can be equipped with a suitable control device or other means (such as the aforementioned switch) for interrupting the connection between the motor means on the one hand and the pump means and starter wheel on the other hand. Such interrupting means or some additional means may serve to connect the pump means with or to disconnect the pump means from the motor means in dependency on the pressure of fluid in the system. The just mentioned connecting/disconnecting means can comprise a suitable pressure monitoring device. Such pressure monitoring device can include a switch which is actuated when the fluid pressure reaches a certain value. The connecting/disconnecting means can also be designed to be operative as a function of the condition of the clutch means, e.g., clutch means of the type disclosed in commonly owned U.S. Pat. No. 4,325,472. The interrupting and/or connecting/disconnecting means can further serve as, or it may be provided in addition to, a means for holding the starter wheel and the flywheel out of torque-transmitting or torque-receiving engagement with one another. Such holding means is also operable in dependency on the pressure of fluid in the fluid-containing system of the clutch actuating means and/or in dependency on the condition of the clutch means (i.e., in engaged or disengaged condition of the clutch means). The holding means or some separate means can serve to move the starter wheel into engagement with the flywheel or vice versa in dependency on the pressure of fluid in the fluid-containing system of the clutch actuating means and/or in dependency on the condition of the clutch means. The means for selectively connecting the pump means and/or the starter wheel with the motor means can also be operated in dependency on the pressure of fluid in the fluid-containing system of the clutch actuating means. Such connecting means can be analogous to or identical with the aforediscussed pressure monitoring device.

The clutch actuating means can comprise a membrane and a linkage which is movable by the membrane to engage or disengage the clutch means, and such engaging/disengaging means may be of the type wherein a device (e.g., the membrane) is movable between first and second positions in which the clutch means (such as the clutch means disclosed in U.S. Pat. No. 4,325,472) is respectively engaged and disengaged. The means for selectively connecting the motor means with the pump means and with the starter wheel can be designed to be activated in response to movement of the aforementioned device to one of its positions or while such device assumes one of the first and second positions.

Still further, the apparatus can comprise a torque-receiving means (such as the change-speed transmission of an automotive vehicle), and second clutch means which is interposed between the engine and the torque-receiving means. The means for selectively connecting can be designed to be activatable in dependency on the condition of at least one of the two clutch means.

The pump means and the motor means can constitute an integral unit. The same holds true for the aforementioned holding means, i.e., such holding means can be integral with the motor means. The wheel which is movable into and from engagement with the other wheel is preferably the starter wheel.

The aforementioned moving means can be designed to operate in dependency on the quantity of energy which is stored by the flywheel. To this end, the apparatus can comprise means for monitoring the RPM of the flywheel, and the moving means is then operable in dependency on the flywheel reaching a predetermined RPM.

The motor means can constitute a direct-current shunt motor, and the apparatus can further comprise means for varying the speed of the motor means in dependency on the RPM of one of the wheels, e.g., in dependency on the monitored RPM of the flywheel. Such speed varying means can be influenced by one or more parameters, e.g., by the temperature of air around or by the temperature of water or oil in the engine. The speed of the motor means can be varied infinitely within a predetermined range or in stepwise fashion.

The motor means can comprise a reversible electric motor, and the apparatus can comprise means for operating the pump means while the reversible motor rotates in one direction and means for rotating the starter wheel in response to rotation of the reversible motor in the opposite direction. The reversible motor rotates the flywheel by way of the starter wheel, and the means for rotating the starter wheel can comprise threaded drive means which is interposed between the reversible motor and the starter wheel to connect the latter with the flywheel when the reversible motor rotates in the opposite direction and to disconnect the starter wheel from the flywheel in response to rotation of the reversible motor in the one direction. The means for operating the pump means can comprise freewheel means which is interposed between the reversible motor and the pump means to disconnect the pump means from the reversible motor when the latter rotates in the opposite direction but to enable the reversible motor to operate the pump means when the reversible motor rotates in the one direction. For example, the means for operating the pump means can further comprise a shaft which is driven by the reversible motor and carries a cam disc capable of operating the pump means when it receives torque from the drive shaft; the freewheel means is then interposed between the drive shaft and the cam disc.

The apparatus which includes a reversible motor can comprise fluid-operated means for reversing the direction of rotation of the reversible motor. It is also possible to reverse the direction of rotation of the reversible motor in response to changes in the condition of the clutch means, e.g., in response to disengagement of the clutch means. Still further, it is possible to reverse the current feed to the reversible motor. For example, the circuit which supplies current to the reversible motor can contain a double pole switch which can be actuated to reverse the current feed to the reversible motor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
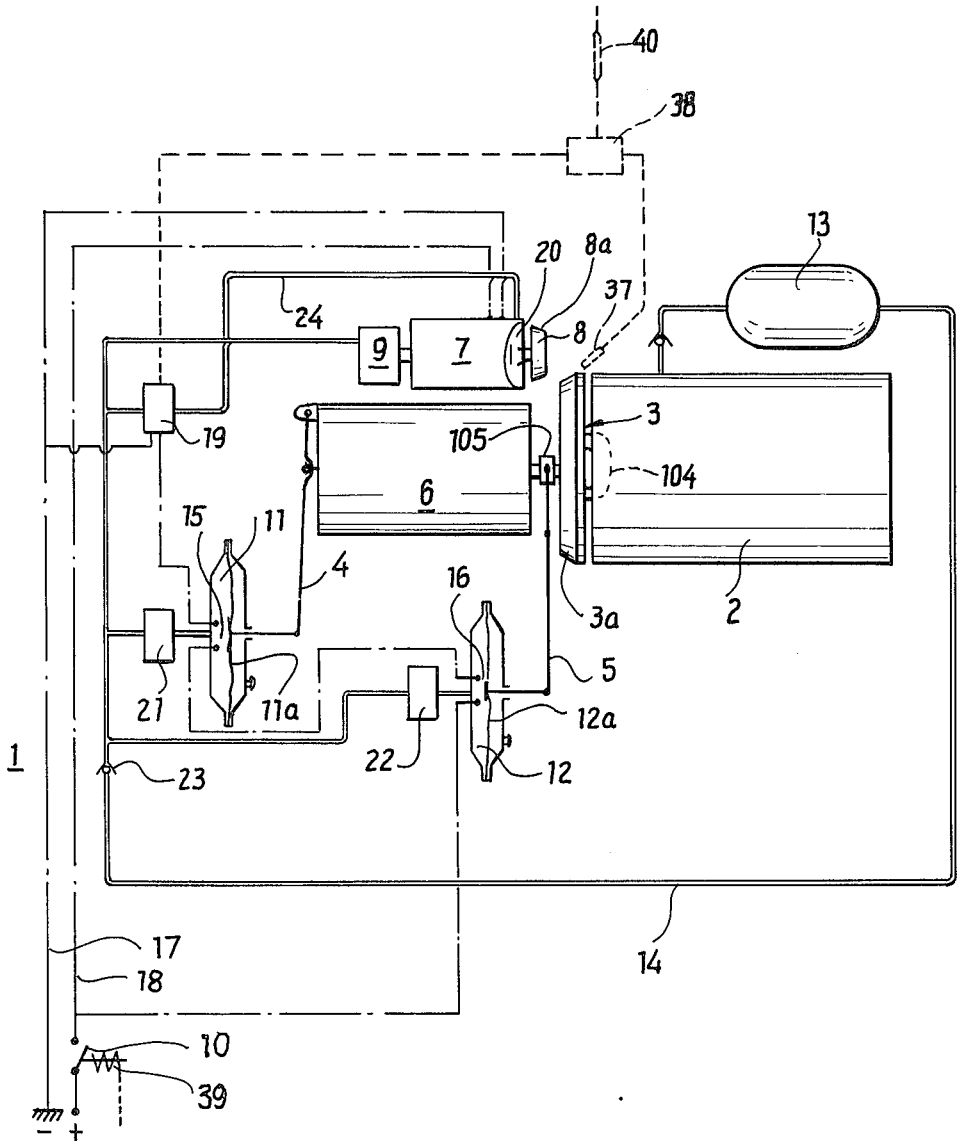
FIG. 1 is a diagrammatic view of an apparatus which employs a first type of motor means and serves to start the internal combustion engine of an automotive vehicle.

Referring first to FIG. 1, there is shown an apparatus 1 for starting an internal combustion engine 2 with a flywheel 3 which latter can be automatically coupled to or disconnected from the crankshaft (not specifically shown) of the engine 2 by a first clutch 104 (e.g., a friction clutch of the type shown at 1 in FIG. 1 of U.S. Pat. No. 4,325,472) through the medium of a linkage 4. A torque-receiving device, here shown as a change-speed transmission 6, can be coupled to or disconnected from the crankshaft of the engine 2 by a second clutch 105 (e.g., a friction clutch of which only the release means is shown in FIG. 1) through a linkage 5. The linkage 5 would actuate the clutch 2 shown in FIG. 1 of U.S. Pat. No. 4,325,472 whose disclosure is incorporated herein by reference. The apparatus 1 further comprises an electric starter motor 7 which is operable in response to closing of a switch 10 to drive a starter wheel 8 (e.g., a friction wheel having a conical peripheral surface 8*a*) and/or to automatically start a vacuum or compressor pump 9. The switch 10 can be closed in response to turning of the ignition key by the operator of the automotive vehicle which embodies the internal combustion engine 2.

Prior to proceeding with starting of the eingine 2, the clutches 104 and 105 must be disengaged so that the starter wheel 8 can accelerate the flywheel 3 to a predetermined speed. When the flywheel 3 reaches the predetermined (preferably variable) speed, the clutch 104 is automatically engaged by fluid-operated actuating means operating through the linkage 4 so that the flywheel 3 is coupled to and can transmit torque to the crankshaft of the engine 2 whereby the engine is started.

FIG. 1 shows a fluid-operated clutch actuating means including pneumatic actuators 11 and 12 which respectively comprise membranes 11*a* and 12*a* and are normally connected with a fluid-containing system including a suction generating device 13 (or a source of compressed gas) and a suction (or pressure) line 14. In the positions corresponding to disengaged conditions of the clutches 104 and 105, the membranes 11*a*, 12*a* of the actuators 11, 12 complete an electric circuit 17, 18 for the starter motor 7 through switches 15, 16, respectively. The linkages 4 and 5 then assume positions other than those shown in FIG. 1. This establishes an electrical connection between the conductors of the circuit 17, 18 through the medium of the switches 15, 16. The pump 9 is driven before the switches 15, 16 close; these switches close when the fluid pressure reaches a predetermined value, and such closing results in rotation of the starter wheel 8 in lieu of rotation of the shaft of the pump 9. The clutches 104 and 105 are then disengaged. At the same time, closing of the switches 15, 16 entails an energization of the solenoid of an electromagnetic valve 19 which is installed in the pneumatic system of the apparatus 1 to connect the line 14 with a conduit or line 24 so that the latter connects the device 13 with a highly versatile control device 20 for the motor 7. The purpose of the control device 20 is to move the conical peripheral surface 8*a* of the starter wheel 8 axially toward and from frictional engagement with the conical peripheral surface 3*a* of the flywheel 3. The exact design of the control device 20 is not specifically shown in FIG. 1 but it will be explained in greater detail with reference to FIG. 2. It suffices to say here that the control device 20 can hold the starter wheel 8 out of engagement with the flywheel 3, it can move the starter wheel 8 into engagement with the flywheel 3 or can disengage the starter wheel from the flywheel 3, and it can also maintain the conical surface 8*a* in torque-transmitting engagement with the conical surface 3*a*. The control device 20 moves the starter wheel 8 into engagement with the flywheel 3 when the motor 7 is on so that the starter wheel 8 rotates and drives the flywheel 3 to accelerate the latter to the selected predetermined speed, i.e., to a speed which suffices to ensure that the engine 2 is started on engagement of the clutch 104. When the flywheel 3 is accelerated to the desired speed (i.e., when the RPM of the flywheel 3 reaches a preselected value which is proportional to the RPM of the wheel 8), and when certain other requirements (such as that the ignition circuit of the engine be completed, that the pressure in the pneumatic system reach a preselected value, especially in an Otto engine, that the temperature of certain media be within a certain range and/or others such as the conditions under which the vehicle embodying the engine is driven, e.g., close to or well above the sea level) are met, the switch 15 is opened by the membrane 11*a* in response to opening of a conventional electromagnetic control valve 21 which then connects the suction line 14 with the pneumatic actuator 11 (the valve 21 connects the left-hand chamber of the actuator 11 with the atmosphere when the clutch 104 is engaged) so that the linkage 4 engages the clutch 104 which couples the flywheel 3 to the crankshaft of the engine 2 with the result that the engine is started. The valve 21 can also be actuated in response to closing of the switch 10 by returning the ignition key to its initial position to thus start the engine 2. A second electromagnetic control valve 22 initiates selective and controlled operation of the linkage 5 in dependency on the same criteria as the valve 21.

Closing of the switches 15 and 16 can be followed by closing of the aforementioned switch of the pressure monitoring device, preferably when the pressure rises somewhat above that which is needed for closing of the switches 15 and 16.

While the electric starter motor 7 is running, the vacuum or negative pressure system can additionally be evacuated by the pump 9, for example, at such times when the suction which is generated by the device 13 (if the clutch actuating means is operated at less than atmospheric pressure) is not sufficient. The pump 9 can be arrested when the starter wheel 8 drives the flywheel 3, either by superatmospheric or by subatmospheric pressure or in disengaged condition of the clutches 104 and 105.

If the vacuum in the suction line 14 is insufficient when the switch 10 is actuated, the circuit of the solenoid of the valve 19 is open so that the control device 20 for the starter motor 7 holds the starter wheel 8 in the illustrated position, i.e., at a distance from the flywheel 3. The device 20 is integrated into the motor 7. The motor 7 is started on closing of the switch 10 and automatically operates the pump 9 so that the actuators 11 and 12 disengage the respective clutches 104, 105 through the corresponding linkages 4 and 5. Because of the provision of a check valve 23, the entire vacuum system of the apparatus 1 need not be supplied with negative pressure but rather only the directly affected actuators 11 and 12. This results in rapid disengagement of the clutches 104, 105 and in rapid completion of the circuit of the motor 7 through the switches 15 and 16.

When the switches 15 and 16 are closed, the clutches 104 and 105 are disengaged but the solenoid of the valve 19 is energized and causes the starter wheel 8 to move its conical surface 8*a* axially toward the conical peripheral surface 3*a* of the flywheel 3. This will be explained in greater detail hereinbelow with reference to FIG. 2.

Figure 2:
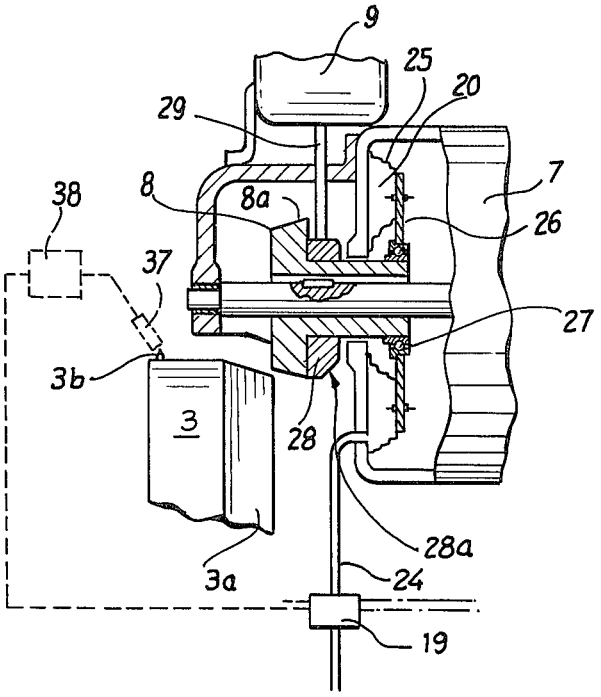
FIG. 2 is an enlarged fragmentary partly elevational and partly sectional view of a detail in the apparatus of FIG. 1.

FIG. 2 shows that the pump 9 is flange-mounted on the housing of the starter motor 7. This Figure further shows the control device 20, the starter wheel 8 and the pneumatic line 24 which connects the solenoid-operated valve 19 with a chamber at one side of an annular membrane or diaphragm 25 of the control device 20. When the electric circuit 17, 18 is completed, i.e., in disengaged condition of the clutches 104 and 105, the solenoid of the valve 19 is energized whereby the diaphragm 25 is acted upon by negative pressure through the line 24 so that the diaphragm 25 and a setting ring 26, which is fastened to the diaphragm, are moved in a direction to the left, as viewed in FIG. 2, by way of an interposed antifriction ball bearing 27 and the conical surface 8*a* of the wheel 8 is also moved in a direction to the left toward the conical peripheral surface 3*a* of the flywheel 3.

The disengagement of the starter wheel 8 from the flywheel 3 is effected by opening the switch 15. This takes place at the beginning of engagement of the flywheel clutch 104 which is controlled by the linkage 4. The solenoid of the valve 19 is thereby energized and the valve 19 can connect the line 24 with the atmosphere. This enables the diaphragm 25 and the wheel 8 to move in a direction to the right. When the flywheel 3 is coupled to the crankshaft of the engine 2, the pump 9 is arrested as follows:

The pump 9 is driven by a rotary eccentric cam 28 and a push rod 29 as soon as and as long as insufficient or inadequate negative pressure or vacuum exists, and as long as the electric circuit 17, 18 is not completed by the switches 15, 16. As soon as the starter wheel 8 is moved in the axial direction and to the left, as viewed in FIG. 2, the eccentric cam 28 slides from under the push rod 29 so that the pump 9 is arrested and power is no longer used to drive the pump 9. When the diaphragm 25 moves the starter wheel 8 and with it the eccentric cam 28 to the right, as viewed in FIG. 2, the cam 28 can again slide under the push rod 29 which slides over a cam face 28*a*.

FIGS. 1 and 2 illustrate, by broken lines, an alternative or additional mode of moving the starter wheel 8 away from the flywheel 3, i.e., of disengaging the conical surfaces 3*a* and 8*a* from one another. To this end, the apparatus of FIGS. 1 and 2 further comprises a monitoring device 37 (e.g., a proximity detector switch which is adjacent to the periphery of the flywheel 3 and generates a signal whenever it is bypassed by a protuberance 3*b* on the flywheel) which transmits signals denoting the RPM of the flywheel 3 to a control circuit 38. When the RPM of the flywheel 3 reaches a certain value (i.e., when the intensity or another characteristic of signal which is transmitted to the control circuit 38 reaches a preselected value), namely, a value which suffices to start the engine 2, the control circuit 38 transmits a signal to the solenoid of the valve 19 to actuate the latter in a sense to connect the line 24 with the atmosphere whereby the friction wheel 8 moves away from the flywheel 3 for reasons which were explained above in connection with FIG. 2.

The control circuit 38 can further serve to transmit signals to a relay 39 which opens the switch 10 as soon as the RPM (monitored by the device 37) of the flywheel 3 reaches the aforementioned value which suffices to start the engine 2, and provided further that the pressure in the pneumatic system of the apparatus is sufficiently low. Opening of the switch 10 results in stoppage of the electric starter motor 7. Since the ratio of the RPM of the motor 7 and starter wheel 8 to the RPM of the flywheel 3 can be determined in advance by appropriate selection of effective diameters of the starter wheel 8 and flywheel 3, the RPM of the motor 7 is automatically limited to the absolutely required level which is needed in order to ensure that the RPM of the flywheel 3 will reach the aforediscussed predetermined value.

The output signal of the control circuit 38 (i.e., that RPM of the flywheel 3 at which the valve 19 connects the line 24 with the atmosphere and/or the relay 39 opens the switch 10 to arrest the motor 7) can be modified or influenced by one or more parameters or criteria, such as the temperature of air, the oil temperature and/or the water temperature of the engine 2, to thus indirectly influence the RPM of the motor 7. If the engine 2 is the internal combustion engine of an automotive vehicle, it is particularly advantageous and desirable if the output signal of the control circuit 38 can be influenced by a detector, e.g., a thermoelement 40, which generates signals whose intensity or another characteristic is a function of the temperature of the monitored fluid, such as oil in the crankcase of the engine. The arrangement may be such that, when the signal from the detector 40 indicates that the oil temperature is low (i.e., that the engine 2 is to be started on a cold day), the control circuit 38 ensures that the RPM of the flywheel 3 will be increased to a relatively high value before the motor 7 is arrested via valve 19 and/or via relay 39. The design of the control circuit 38 can be such that the RPM of the flywheel 3 and motor 7 can be varied infinitely within a relatively wide range. When the air temperature is high, i.e., when the engine 2 is likely to be started without any difficulty, the signal which is transmitted by the detector 40 influences the output signal of the control circuit 38 in such a way that the RPM of the flywheel 3 at which the motor 7 is arrested is relatively low.

Alternatively, the control circuit 38 can be designed to effect stepwise changes of RPM of the motor 7 and flywheel 3. To this end, the field of the motor 7 can be connected with resistor means and means which is actuatable to bypass the resistor means. The resistor means can be bypassed in response to a signal from the detector 40 when the temperature of oil is very low. Such signal indirectly indicates that the temperature of the surrounding air is also low and that the engine is not likely to be started as readily as on a hot day or in a hot climate. Bypassing of the resistor means via control unit 38 automatically entails an acceleration of the flywheel 3 to a higher or lower speed so that the flywheel stores more or less energy as long as the stored energy suffices to reliably start the engine 2 in response to engagemeht of the clutch 104. The resistor or resistors which is or are to be bypassed can be connected in parallel with the field of the motor 7. The RPM of the motor 7 (e.g., a d-c shunt motor) increases in response to connection of a resistor. It is equally possible to employ electronic RPM regulating means.

The apparatus which is shown in FIGS. 1 and 2 can be incorporated with particular advantage in, or can be associated with, a system for operating an internal combustion engine of the type disclosed in the commonly owned allowed patent application Ser. No. 46,056 filed June 6, 1979 by Ernst-Hermann Kohlhage, now U.S. Pat. No. 4,317,435 granted Mar. 2, 1982. The disclosure of the patent to Kohlhage is incorporated herein by reference.

The control device 20 can be designed in such a way that, when the motor 7 is started, the torque-transmitting connection between the pump 9 and the motor 7 is established ahead of a similar connection between the motor 7 and the starter wheel 8. The arrangement may be such that the control device 20 establishes a torque-transmitting connection between the motor 7 and the starter wheel 8 only when the pressure in the fluid-containing system of actuating means for the clutches 104, 105 is sufficiently high or sufficiently low (depending upon whether the fluid-containing system including the parts 13, 14 contains a fluid whose pressure is above or below atmospheric pressure) to ensure that the clutch 104 can be engaged once the speed of the flywheel 3 is increased to a predetermined value which suffices to guarantee that the engine 2 is started on engagement of the clutch 104.

It is further within the purview of the invention to equip the control device 20 with (or to provide discrete) means for selectively connecting the motor 7 with the pump 9 or with the starter wheel 8. Such connecting means can be operated in dependency on the pressure of fluid in the fluid-containing system of the clutch actuating means and/or in dependency on the condition of the clutch 104 and/or 105, especially on the condition of the clutch 104 when the apparatus is installed in an automotive vehicle.

As mentioned above, the control device 20 can be said to constitute a means for holding the wheels 3, 8 in engagement with one another, a means for moving the wheel 8 into and from torque-transmitting engagement with the flywheel 3, and a means for maintaining the starter wheel 8 out of engagement with the flywheel 3. This control device can be operated in dependency on the pressure in the fluid-containing system of actuating means for the clutches i.e., in dependency on the subatmospheric pressure when the apparatus employs suction-operated actuating means for the clutches. A suitable pressure monitoring device can be installed in the fluid-containing system to generate signals which are indicative of the prevailing pressure and which are transmitted to the device 20 or to other suitable means serving to connect the pump 9 with or to disconnect this pump from the motor 7.

As shown in FIG. 2, the device 20 holds the starter wheel 8 out of engagement with the flywheel 3 when the pressure in the fluid-containing system is not satisfactory. The starter wheel 8 is free to engage the flywheel 3 as soon as the pressure in the fluid-containing system is increased or reduced to the desired value and/or as soon as the clutch 105 and/or 104 assumes that condition in which the wheel 8 can drive the flywheel 3. The arrangement may be such that the wheel 8 is automatically moved into torque-transmitting engagement with the flywheel 3 as soon as the pressure in the fluid-containing system is within the acceptable range and/or as soon as the clutches 104, 105 are disengaged. The same holds true for the torque-transmitting connection between the motor 7 and the pump 9. Selective activation of the connections between the motor 7 on the one hand and the starter wheel 8 and pump 9 on the other hand is often desirable and advantageous because it ensures that a relatively small motor suffices to furnish the necessary power to drive the wheel 8 or the pump 9. Moreover, such mode of operation reduces unnecessary wear upon the pump 9 when the motor drives the wheel 8 or vice versa. Thus, the pump 9 can be driven only when the pressure in the fluid-containing system of the actuating means for the clutches 104, 105 is not satisfactory and the pump 9 can be arrested as soon as the necessary or optimum pressure is established. If the presence or absence of a torque-transmitting connection between the pump and the starter motor or between the starter motor and the starter wheel is dependent on the clutch(es), the dependency can be selected in such a way that it is a function of the condition of the clutch 105 and/or 104 or a function of the position of one or more parts (such as membranes 11*a*, 12*a* or linkages 4, 5) which initiate or cause the engagement or disengagement of the clutch(es).

Integration of the pump 9 and/or control device 20 into the motor 7 contributes to simplicity and compactness of the improved apparatus.

The control device 20 or another suitable device ensures that the starter wheel 8 is disengaged from the flywheel 3 when the engine 2 is running. This reduces the likelihood of damage to the motor 7 and/or to the starter wheel 8. Furthermore, this renders it possible to dispense with the customary freewheels which are interposed between the starter motors and engines in conventional apparatus.

The pump 9 can serve to supply fuel to the engine 2. To this end, the pump 9 can be connected with a power take-off which receives motion from the engine and drives the pump when the engine is in operation.

As stated above, the connection between the engine 2 and the flywheel 3 is interrupted automatically in response to starting of the motor 7 via switch 10, e.g., by the aforediscussed fluid-operated means. This ensures that the motor 7 can drive the pump 9 while the flywheel 3 is disconnected from the engine 2. Alternatively, the pump 9 can be driven by the internal combustion engine 2 through a freewheel clutch which is constructed assembled and mounted in such a way that the pump 9 is driven by the motor 7 when the engine 2 is idle.

The improved apparatus can also constitute a pressure or suction generating unit, for example, to adjust the fuel injection pump during or preparatory to starting of a diesel engine.

Figure 3:
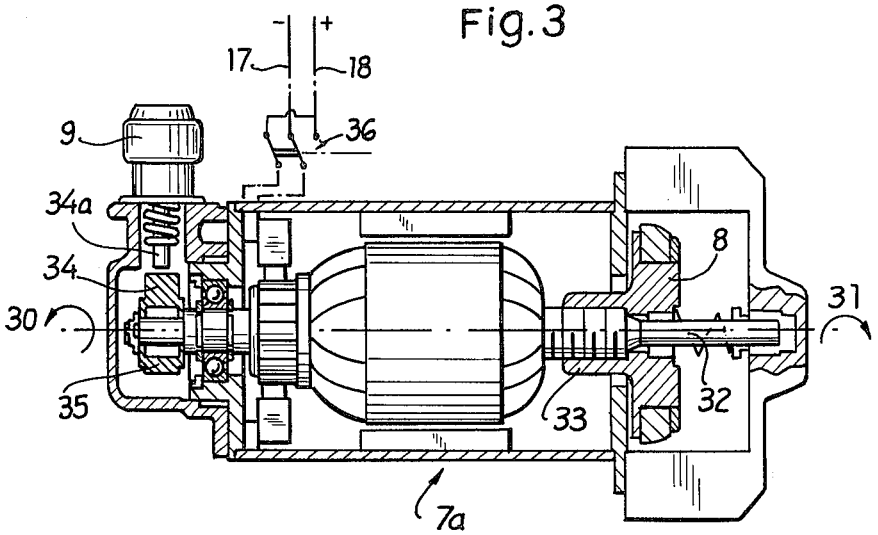
FIG. 3 is a fragmentary partly elevational and partly sectional view of a detail in an apparatus utilizing modified motor means.

FIG. 3 shows a reversible electric motor 7*a*. For example, the motor 7*a* may constitute a direct-current shunt motor with four poles whereby rotation of the motor shaft 32 to the left or counterclockwise, as indicated by the arrow 30, entails actuation of the pump 9 which is again integrated into the motor 7*a*. Rotation of the motor shaft 32 in a direction to the right or clockwise, as indicated by the arrow 31, results in transmission of torque to the flywheel 3.

FIG. 3 further shows that the internally threaded wheel 8 surrounds an externally threaded portion 33 of the motor shaft 32. This threaded connection causes the wheel 8 to move axially toward the flywheel 3 when the motor shaft 32 rotates clockwise. The wheel 8 moves away from the flywheel 3 when the shaft 32 rotates counterclockwise. This prevents damage to the motor 7*a* and to the flywheel 3 when the motor 7*a* is operated to rotate the shaft 32 in a counterclockwise direction so that only the pump 9 is driven. For this purpose, the motor shaft 32 carries an eccentric cam disc 34 surrounding a freewheel or slip clutch 35 and cooperating with a reciprocable push rod 34*a* of tne pump 9. In this way, the shaft 32 drives the eccentric 34 only when the shaft 32 of the motor 7*a* rotates in the direction of the arrow 30. The pump 9 is not driven (i.e., the push rod 34*a* is not reciprocated) when the shaft 32 rotates in the direction of arrow 31.

The direction of rotation of the shaft 32 is controlled by a reversing switch 36 which, in turn, can be controlled in dependence on the existing negative pressure and/or in dependence on the disengaged condition of the clutches 104 and 105.

The conductors of the electric circuit 17, 18 are connected to the reversing switch 36 so that, in response to closing of the switch 10 by the ignition key, the electric motor 7*a* is supplied with current. FIG. 3 shows the switch 36 in a state in which the clutches 104 and 105 are not yet disengaged, i.e., in a state when the negative pressure has not yet caused a closing of the switches 15, 16 and in a position in which the shaft 32 of the motor 7*a* rotates in the direction indicated by arrow 30. The pump 9 is then operated and, with the switches 15, 16 closed, i.e., with the clutches 104, 105 in disengaged condition, the switch 36 reverses poles so that the direction of rotation of the shaft 32 is reversed, namely, the shaft 32 rotates in the direction indicated by arrow 31. The wheel 8 is thereby moved in the axial direction and drives the flywheel 3. The switch 36 can be constructed in such a way that it is controlled only by negative pressure and, at sufficient vacuum, already assumes a position to direct, or to prepare, the motor 7*a* for right-hand operation, or to start the left-hand rotation only when the negative pressure is not sufficient.

An advantage of the apparatus which embodies the structure of FIG. 3 is that there is no need to provide discrete means for retracting the starter wheel 8 from engagement with the flywheel 3 when the motor 7*a* is to drive only the pump 9 or vice versa. Such retraction takes place automatically by the simple expedient of changing the position of the reversing switch 36.

The push rod 29 of FIG. 2 or the push rod 34*a* of FIG. 3 can be replaced by a strap of the type often used with eccentrics or by any other device which, in combination with the eccentric cam 28 or 34, imparts reciprocatory movements to one or more components of the pump 9. If desired, the pump 9 can be mounted in such a way that its push rod 29 or 34*a* is parallel to the axis of the shaft of the starter motor; the eccentric 28 or 34 is then replaced with an axial or thrust cam which can cooperate with a spring to reciprocate the axially parallel push rod. The freewheel 35 ensures that the pump 9 of FIG. 3 ceases to be driven as soon as the switch 36 causes the motor shaft 32 to rotate in the direction of arrow 31, i.e., as soon as the starter wheel 8 begins to move toward and into torque-transmitting engagement with the flywheel. As stated above, the switch 36 can change the direction of rotation of the motor shaft 32 in response to signals which are indicative of the pressure in the fluid-containing system of actuating means for the clutches and/or in dependency on disengaged condition of such clutches.

The apparatus of the present invention has been found to be especially suited for use in automotive vehicles. However, such apparatus can be used with equal or similar advantage to start stationary engines, e.g., engines which drive various types of pumps (such as heat pumps) or other aggregates.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for starting an engine by a flywheel, particularly for starting the internal combustion engine of a vehicle, comprising clutch means interposed between the engine and the flywheel; a starter wheel, one of the wheels being movable into and from engagement with the other of the wheels in disengaged condition of the clutch means to accelerate the flywheel to a predetermined speed at which the flywheel can start the engine in response to engagement of the clutch means; fluid-operated actuating means arranged to automatically engage the clutch means and to thus start the engine when the flywheel is accelerated to the predetermined speed, said actuating means including pump means; and single electric motor means for driving the starter wheel as well as the pump means.

2. The apparatus of claim 1, wherein said actuating means includes a fluid-containing system wherein the pressure of fluid changes when the motor means drives the pump means.

3. The apparatus of claim 2, further comprising means for connecting the motor means with the pump means on starting of the motor means and prior to establishment of a driving connection between the motor means and the starter wheel so that the pump means changes the pressure of fluid in the system to a preselected value at which the actuating means connects the motor means with the starter wheel.

4. The apparatus of claim 1, further comprising means for selectively connecting the motor means with the pump means and flywheel by way of said starter wheel on demand.

5. The apparatus of claim 1, further comprising means for interrupting the connection between the motor means on the one hand and the pump means and the flywheel on the other hand.

6. The apparatus of claim 1, wherein the actuating means includes a fluid-containing system in which the pressure of fluid changes when the motor means drives the pump means, and further comprising means for connecting the pump means with and for disconnecting the pump means from the motor means in dependency on the pressure of fluid in the system.

7. The apparatus of claim 6, wherein the connecting and disconnecting means comprises a pressure monitoring device.

8. The apparatus of claim 6, wherein the connecting and disconnecting means is operative in dependency on the condition of the clutch means.

9. The apparatus of claim 1, further comprising means for holding the wheels out of engagement with one another.

10. The apparatus of claim 9, further comprising means for operating the holding means in dependency on the pressure of fluid in the actuating means.

11. The apparatus of claim 9, further comprising means for operating the holding means in dependency on the condition of the clutch means.

12. The apparatus of claim 1, further comprising means for moving the one wheel into and from engagement with the other wheel.

13. The apparatus of claim 12, further comprising means for operating the moving means in dependency on the pressure of fluid in the actuating means.

14. The apparatus of claim 12, further comprising means for operating the moving means in dependency on the condition of the clutch means.

15. The apparatus of claim 1, further comprising means for selectively connecting the motor means with the pump means and the flywheel in dependency on the pressure of fluid in the clutch actuating means.

16. The apparatus of claim 1, wherein said actuating means comprises means for engaging and disengaging the clutch means including a device movable between first and second positions in which the clutch means is respectively engaged and disengaged, and further comprising means for selectively connecting the motor means with the pump means and the flywheel in dependency on the position of the device.

17. The apparatus of claim 1, further comprising torque-receiving means, second clutch means interposed between the torque-receiving means and the engine, and means for selectively connecting the motor means with the pump means and the flywheel in dependency on the condition of at least one of the clutch means.

18. The apparatus of claim 17, wherein the torque-receiving means includes a change-speed transmission.

19. The apparatus of claim 1, wherein the pump means and the motor means form an integral unit.

20. The apparatus of claim 1, further comprising means for holding the one wheel out of engagement with the other wheel, the holding means being integral with the motor means.

21. The apparatus of claim 1, further comprising means for moving the one wheel into and from engagement with the other wheel, the moving means being integral with the motor means.

22. The apparatus of claim 1, wherein the one wheel is the starter wheel, and further comprising means for moving the starter wheel out of engagement with the flywheel.

23. The apparatus of claim 22, wherein the flywheel stores energy in response to rotation by the starter wheel and the moving means is operable as a function of the quantity of energy stored in the flywheel.

24. The apparatus of claim 22, further comprising means for monitoring the RPM of the flywheel, the moving means being operable in dependency on the flywheel reaching a predetermined RPM.

25. The apparatus of claim 22, further comprising means for operating the moving means in dependency on the condition of the clutch means.

26. The apparatus of claim 1, wherein the motor means includes a direct-current shunt motor.

27. The apparatus of claim 1, further comprising means for varying a predetermined speed of the motor means in dependency on the RPM of one of the wheels and means for influencing said varying means in dependency on at least one parameter.

28. The apparatus of claim 27, wherein the parameter is the temperature of a fluid.

29. The apparatus of claim 1, further comprising means for infinitely varying a predetermined speed of the motor means within a predetermined range.

30. The apparatus of claim 1, further comprising means for varying a predetermined speed of the motor means in stepwise fashion.

31. The apparatus of claim 1, wherein said motor means includes a reversible motor and further comprising means for reversing the direction of rotation of said reversible motor.

32. The apparatus of claim 31, further comprising means for operating said pump means while said reversible motor rotates in one direction and means for rotating said starter wheel in response to rotation of said reversible motor in the opposite direction.

33. The apparatus of claim 32, wherein said reversible motor is arranged to rotate said flywheel by way of said starter wheel and further comprising threaded drive means interposed between said reversible motor and said starter wheel for connecting said starter wheel with said flywheel when said reversible motor rotates in one direction and for disconnecting said starter wheel from said flywheel in response to rotation of said reversible motor in the other direction.

34. The apparatus of claim 33, further comprising freewheel means interposed between said reversible motor and said pump means to disconnect said reversible motor from said pump means when said reversible motor rotates in said one direction but to transmit motion from said reversible motor to said pump means when said reversible motor rotates in said other direction.

35. The apparatus of claim 34, further comprising a drive shaft receiving torque from said reversible motor and a cam disc provided on said drive shaft to operate said pump means, said freewheel means being interposed between said cam disc and said shaft so that said cam disc can operate said pump means only when said reversible motor rotates in said other direction.

36. The apparatus of claim 31, wherein said reversing means comprises fluid-operated means.

37. The apparatus of claim 31, wherein said reversing means is responsive to changes in the condition of said clutch means.

38. The apparatus of claim 31, wherein said reversing means comprises means for reversing the current feed to said motor.

39. The apparatus of claim 31, further comprising a circuit for supplying current to said reversible motor, said reversing means comprises a switch installed in said circuit and operable to reverse the current feed.

40. The apparatus of claim 39, wherein said switch is a double pole switch.

* * * * *

UNITED STATES PATENT AND TRADEMARK OFFICE

CERTIFICATE OF CORRECTION

PATENT NO. : 4,487,173

DATED : December 11, 1984

INVENTOR(S) : Paul MAUCHER et al.

It is certified that error appears in the above-identified patent and that said Letters Patent are hereby corrected as shown below:

Foremost page [30] Foreign Application Priority Data: change "December 18, 1978" to --December 8, 1978--.

Signed and Sealed this

*Thirtieth* Day of *July 1985*

[SEAL]

*Attest:*

DONALD J. QUIGG

*Attesting Officer* *Acting Commissioner of Patents and Trademarks*